United States Patent [19]

Bailey, deceased et al.

[11] Patent Number: 4,492,418

[45] Date of Patent: Jan. 8, 1985

[54] LATERAL FILING DRAWERS

[75] Inventors: Arthur Bailey, deceased, late of Montreal, Canada; by Vici Bailey, executor, 6300 Lennox, Montreal, Canada

[73] Assignee: Vici Bailey, Montreal, Canada

[21] Appl. No.: 469,447

[22] Filed: Feb. 24, 1983

[51] Int. Cl.[3] ..... E05B 65/46

[52] U.S. Cl. ..... 312/220; 312/215; 312/222; 312/311

[58] Field of Search ..... 312/107.5, 192, 215, 312/220, 221, 216, 222, 270, 295, 311, 333, 350, 313, 271, 276; 108/160, 131, 80, 81

[56] References Cited

U.S. PATENT DOCUMENTS

| | | | |
|---|---|---|---|
| 188,948 | 3/1877 | Reynolds | 312/311 |
| 324,518 | 8/1885 | Bates | 312/295 X |
| 421,384 | 2/1890 | Casper | 108/81 |
| 1,592,119 | 7/1926 | McLaughlin et al. | 312/313 |
| 2,122,501 | 7/1938 | Thomas | 312/313 |
| 2,148,823 | 2/1939 | Lapeyre | 108/131 |
| 2,405,668 | 8/1946 | Paxton et al. | 312/311 |
| 2,604,373 | 7/1952 | Beriou et al. | 312/313 |
| 2,867,485 | 1/1959 | Schmidt | 108/131 |
| 3,223,466 | 12/1965 | Roberts | 312/328 |
| 3,290,106 | 12/1966 | Wilson et al. | 312/222 |
| 3,357,729 | 12/1967 | Krueger | 108/160 |
| 3,446,545 | 5/1969 | Horlacher | 312/311 |
| 3,602,564 | 8/1971 | Lewin | 312/220 |
| 3,969,008 | 7/1976 | Pergler | 312/320 |
| 4,103,626 | 8/1978 | Barricks | 108/160 X |
| 4,303,287 | 12/1981 | Taplin | 312/220 X |

*Primary Examiner*—William E. Lyddane
*Assistant Examiner*—Thomas A. Rendos
*Attorney, Agent, or Firm*—Cushman, Darby & Cushman

[57] ABSTRACT

A filing cabinet with a frame defining an enclosure and having two or more drawer openings; a door is hinged to the frame at the bottom of each opening, each door being swingable downward to reach a substantially horizontal position and swingable upward to reach a substantially vertical closed position; links are provided to connect the frame to the door to hold the door in the horizontal position; a drawer is provided at each opening and is mounted on rollers so that it may be rolled out of the enclosure onto the door in the opened position; the doors are locked in the vertical position when one of the doors is in the horizontal position.

7 Claims, 6 Drawing Figures

LATERAL FILING DRAWERS

FIELD OF THE INVENTION

The present invention pertains to a filing cabinet and, more particularly, to filing cabinets of the side opening type.

BACKGROUND OF THE INVENTION

Side opening filing cabinets have been known and used for many years. Some filing cabinets, such as the one described in U.S. Pat. No. 3,446,545 issued May 27, 1969 to Horlacher use the opened door to support the drawer thus eliminating costly suspensions and providing greater capacity for filing. However, side opening filing cabinets, whether of the type where the doors open to receive the drawer or of the type where the drawer with its suspension system is drawn from the cabinet, need some locking arrangement to prevent the user from opening more than one door or pulling out more than one drawer. In the above described patent, no such system is disclosed.

OBJECTS AND STATEMENT OF THE INVENTION

It is therefore an object of the present invention to provide a side opening filing cabinet of the type where the door is opened into a horizontal position and the drawer rolled thereon and where a locking means is provided to prevent opening the doors of other shelves of the filing cabinet when one door is already in an opened horizontal position.

This is achieved by providing a filing cabinet which comprises, in its broadest aspect: a frame defining an enolosure and having two or more drawer openings; a door hinged to the frame at the bottom of each opening, the door being swingable downward to reach a substantially horizontal opened position and swingable upward to reach a substantially vertical closed position; link means connecting the frame to the door to hold the door in the horizontal position; a drawer at each opening having roller means whereby the drawer may be rolled out of the enclosure onto the door when opened and means for locking those doors in the vertical closed position when one of the doors is in the horizontal opened position.

The scope of applicability of the present invention will become apparent from the detailed description given hereinafter; it should be understood, however, that this description while indicating preferred embodiments of the invention is given by way of illustration only since various changes and modifications within the spirit and scope of the invention will become apparent to those skilled in the art.

BRIEF DESCRIPTION OF THE DRAWINGS

FIG. 2 is an elevation cross-sectional view showing part of the filing cabinet;

DESCRIPTION OF PREFERRED EMBODIMENTS

Figure 1:
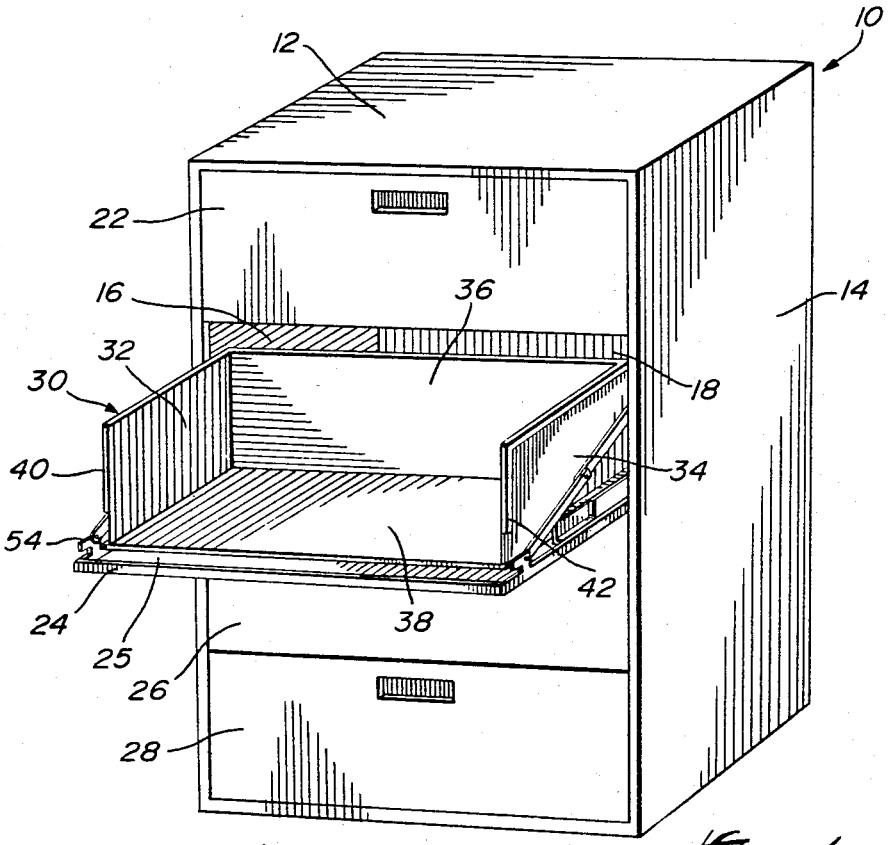
FIG. 1 is a perspective view of a side opening filing cabinet made in accordance with the present invention.
Figure 4:
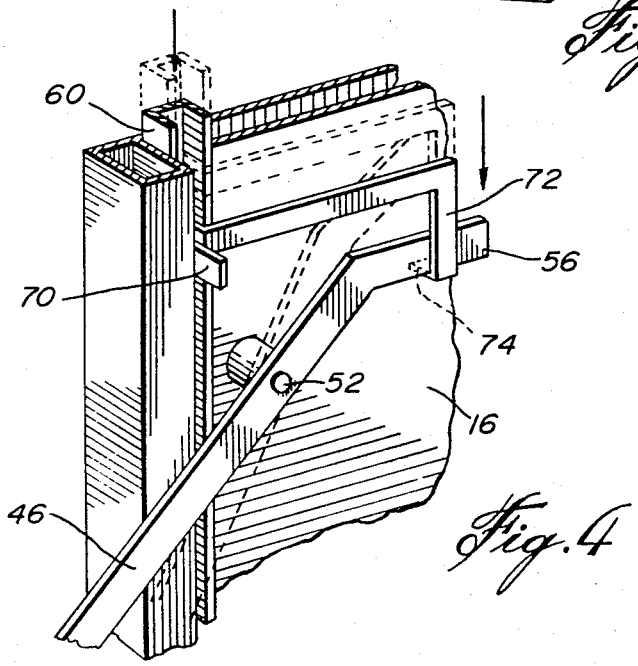
FIG. 4 is a perspective partial view showing the locking mechanism upon opening one door; this figure is seen on the same sheet illustrating FIG. 1.

Referring to FIGS. 1 and 2, there is shown a side opening filing cabinet, generally denoted 10, the frame of which includes a top wall 12, opposite sidewalls 14 and 16, a rear wall 18 and a bottom wall 20. This frame defines an enclosure, the front part of which consists of a series of openings which are closed by a corresponding number of doors, (in the present embodiment, four doors designated 22, 24, 26, 28).

In FIGS. 1 and 2, doors 24 and 26 are, respectively, shown in a horizontal opened position while the remaining doors are in a vertical closed position. The doors are swingable downward to reach the horizontal position. Once a door is opened, a drawer 30 may be rolled out of the opening onto the rear face of the opened door. The drawer has opposite sidewalls 32 and 34, a rearwall 36 and a bottom wall 38. The opposite sidewalls 32 and 34 have their front edges 40 and 42 cut in the lower part, the function of which will be described hereinbelow. Each drawer has a pair of rollers 41 mounted adjacent each sidewall 40, 42 at the lower part thereof. These rollers are adapted for rolling engagement in a pair of tracks 43 disposed at vertically spaced locations along each sidewall 14, 16 of the cabinet.

In order to maintain the door in the horizontal position, a pair of link connections are provided on each side between the frame and the door and consists of a pair of arms 44 and 46 which are interconnected at one end 48 thereof. The opposite end of arm 44 is pivotally connected to the door at 50 while the opposite end of arm 46 is pivotally connected to the cabinet sidewall at 52. The door part connected at 50 includes a lock receiving extension 54 while the opposite end of arm 46 has a finger extension 56.

Figure 3:
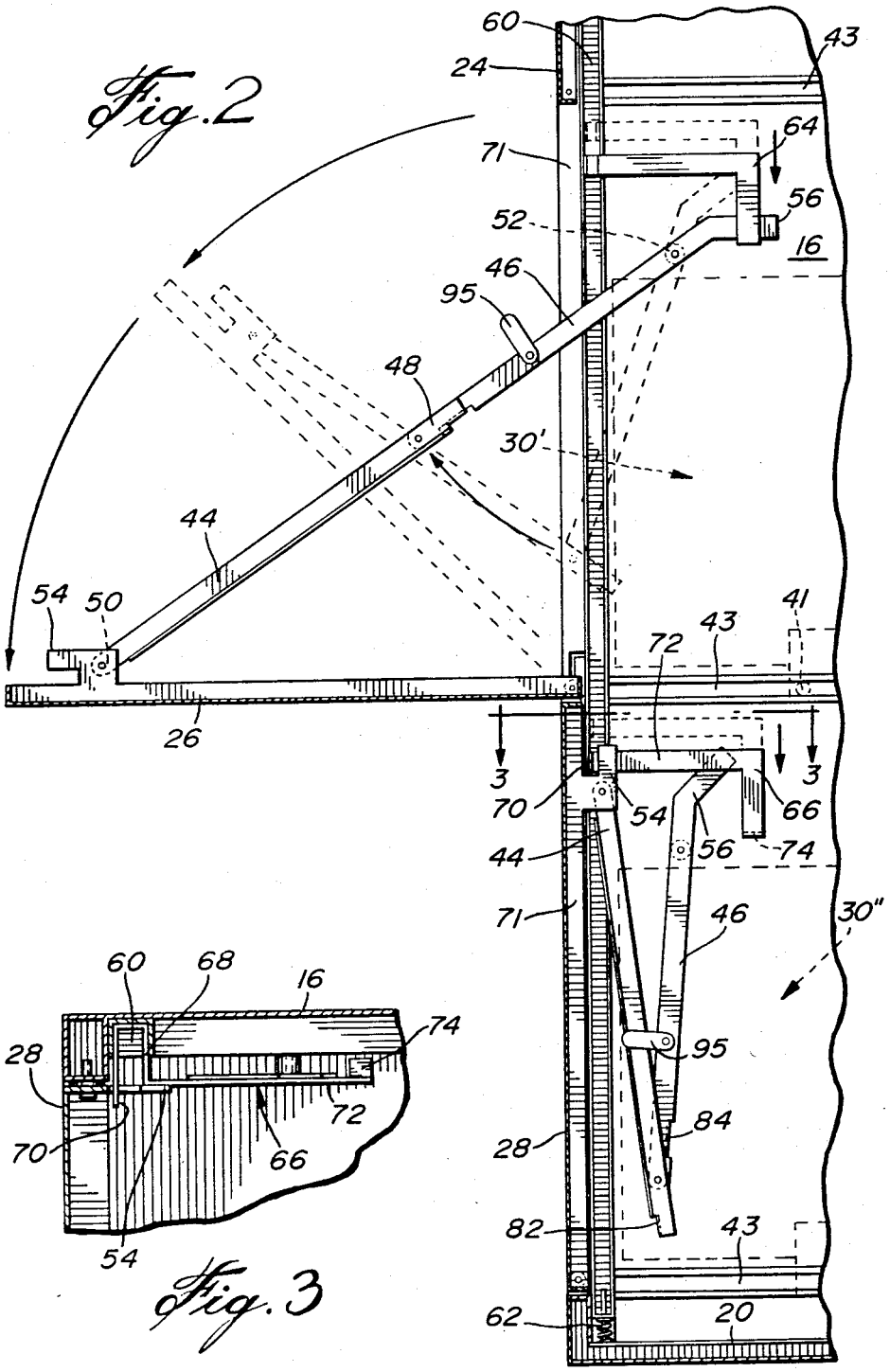
FIG. 3 is a cross-section partial view taken along lines 3—3 of FIG. 2.
Figure 5:
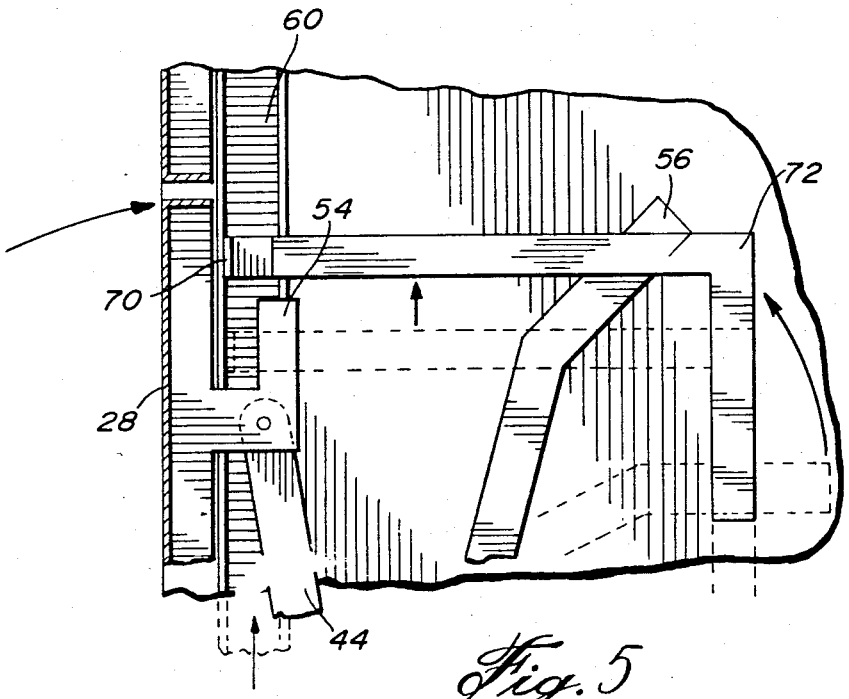
FIG. 5 is an elevation partial view showing the locking mechanism when all doors are closed.

One feature of the present invention is the locking arrangement which ensures that, once a door is opened in the horizontal position, it is impossible to open another door or to move it from its vertical closed position. This locking arrangement comprises a vertically displaceable U-shaped rail 60 which is urged upwardly under the action of a spring 62 located on the bottom wall 20. At vertically spaced locations along this rail, a series of levers such as that shown as 64 and 66 in FIG. 2 are provided. Referring to FIG. 3, lever 66 includes a U-shaped portion 68 which is fixed, for example by welding, to the U-shaped rail 60, portion 68 having a projection 70 extending beyond the side edge 71 and adapted to be received in the lock receiving element 54 of the door. Element 66 also includes an L-shaped portion 72, the lowermost end of which has an inturned edge 74 which is adapted to be engaged by finger 56 of the arm 46.

In FIG. 2, the arms 44 and 46 adjacent door 28 have complementary shaped end portions 82 and 84 which limit the outward movement of the arms passed the oblique position shown. These portions 82 and 84 interlock one another when in the oblique position.

Figure 6:
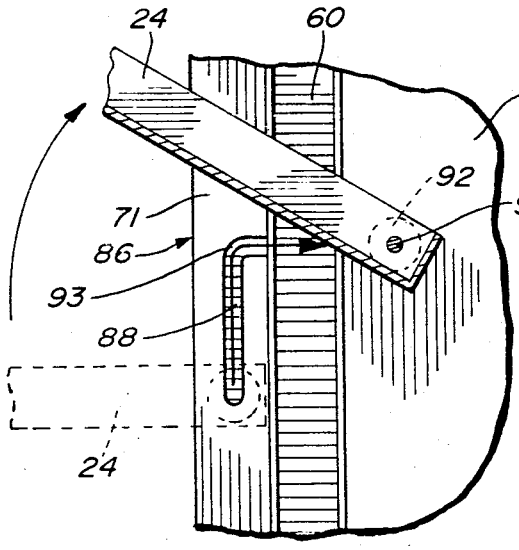
FIG. 6 is an elevation partial view showing the mounting arrangement of a door to the frame of the cabinet.

Referring to FIG. 6, the opposite sidewalls 14 and 16 have an inturned front edge 86 defining a hollow chamber on each opposite side of the cabinet. Along wall 71 of this edge, a series of vertically spaced slots 88 are adapted to receive therein pin 90 which has one end fixed to the door and the other secured to a roller 92 which, once the door is installed, is received in the hollow chamber. It can be seen that quick and easy removal of door 24 is accomplished by lifting the door upwardly and inwardly as indicated by arrow 93.

A description of the locking operation will now be described with reference to FIG. 2. When all the doors are closed, springs 62 cause rails 60 to move upward whereby all projections 70 are outside their respective locking element 54. On the other hand, when a door (such as door 26) is opened, finger elements 56 on each side of the cabinet engage projections 74 of the levers causing them to be lowered. This results also in the lowering of rails 60 against the action of springs 62 since the levers are fixedly attached to the rails 60. As the rails are lowered, each projection 70 engages the lock element 54 of each door. Hence, once door 26 is opened, it is impossible to open remaining doors 22, 24, 28.

Although the invention has been described in relation to a specific form, it will be evident to the man skilled in the art that it may be refined and modified in various ways. For example, there are various ways of causing opposite rails 60 to be urged. Also, a clip 95 may be provided on arm 46 to retain, through a snap engagement, arm 44 when the arms are folded in the closed door condition. It is therefore wished to have it understood that the present invention should not be limited in interpretation except by the terms of the following claims.

The embodiments of the invention in which an exclusive property or privilege is claimed are defined as follows:

1. A filing cabinet comprising:

a frame defining an enclosure and having two or more drawer openings;

a door hinged to said frame at the bottom of each opening, said door being swingable downward to reach a substantially horizontal opened position and swingable upward to reach a substantially vertical closed position;

link means consisting of a pair of foldable arms piviotally connected to one another at one end thereof, and at the other ends thereof to a respective one of said door and said frame, at each side of said frame to hold said door in said horizontal position;

a drawer at each said opening; said drawer having roller means whereby said drawer may be rolled out of said enclosure onto said door in said horizontal opened position; and lock receiving means on a rear face of each door at the upper part thereof; one of said arms having its opposite end fixed to said door adjacent said lock receiving means; the other of said arms having finger means at its opposite end; a door locking means consisting of an elongated rail extending vertically of said frame from bottom to top of said enclosure adjacent said openings, and of lever means having one end fixedly attached to said rail and the other end adapted to engage said finger means, the engagement of said lever means being such that, when one door is in the opened horizontal position, all remaining doors are locked as a result of said one end of said lever means being engaged in said lock receiving means of closed doors.

2. A filing cabinet as defined in claim 1, wherein said frame includes opposite inner side walls; track means fixedly mounted to said side walls in the areas of said bottom of each opening to rollably receive therein the roller means of said drawers.

3. A filing cabinet as defined in claim 1, wherein said door locking means include spring means biasing said rail upwardly so as to free said one end of each lever means from said lock receiving means when all doors are in the closed position.

4. A filing cabinet as defined in claim 3, said lock receiving means being provided on opposite sides of said frame.

5. A filing cabinet as defined in claim 1, wherein said arms in their connecting area includes means for interlocking said arms when the door is in the opened horizontal position.

6. A filing cabinet as defined in claim 1, wherein one of said arms includes a clip for engaging the other arm when said door is closed to thereby prevent said door from accidentally falling in an opened position.

7. A filing cabinet as defined in claim 1, wherein said frame includes a series of vertically spaced slots at the hinge of said door; means on said door engaging said slots; said slots being shaped to facilitate quick removal of said door from said frame.

* * * * *